United States Patent [19]

Kerr et al.

[11] 4,227,964

[45] Oct. 14, 1980

[54] METHOD OF TREATING LIGNOCELLULOSIC OR CELLULOSIC PULP TO PROMOTE THE KINKING OF PULP FIBRES AND/OR TO IMPROVE PAPER TEAR STRENGTH

[76] Inventors: Allan J. Kerr; Robert P. Kibblewhite, both of Private Bag, Rotorua, New Zealand

[21] Appl. No.: 23,768

[22] Filed: Mar. 26, 1979

Related U.S. Application Data

[63] Continuation of Ser. No. 855,677, Nov. 29, 1977, abandoned.

[30] Foreign Application Priority Data

Dec. 1, 1976 [NZ] New Zealand ..... 182782
Jun. 7, 1977 [NZ] New Zealand ..... 184312

[51] Int. Cl.[2] ..... D21C 9/00

[52] U.S. Cl. ..... 162/9; 162/53; 162/63

[58] Field of Search ..... 162/63, 65, 72, 90, 162/9, 50, 53

[56] References Cited

U.S. PATENT DOCUMENTS

| | | | |
|---|---|---|---|
| 3,472,731 | 10/1969 | Liebergott et al. | 162/63 |
| 3,617,432 | 11/1971 | Clayton et al. | 162/63 |
| 3,622,444 | 11/1971 | Andrews | 162/85 |
| 3,630,828 | 12/1971 | Liebergott et al. | 162/65 |
| 3,652,305 | 3/1972 | Noreus et al. | 162/65 |
| 3,707,436 | 12/1972 | O'Connor | 162/63 |
| 3,740,311 | 6/1973 | Liebergott et al. | 162/65 |
| 3,759,783 | 9/1973 | Samuelson et al. | 162/65 |
| 3,832,276 | 8/1974 | Roymoulik et al. | 162/65 |
| 3,951,734 | 4/1976 | Deltaas et al. | 162/90 |
| 4,002,526 | 1/1977 | Brown et al. | 162/63 |

FOREIGN PATENT DOCUMENTS

| | | | |
|---|---|---|---|
| 313085 | 2/1930 | United Kingdom | 162/90 |
| 1381728 | 1/1975 | United Kingdom . | |

OTHER PUBLICATIONS

Osawa et al., "The Action of Gaseous Reagents on Cellulosic Materials, II" Tapp vol. 46, No. 2, Feb., 1963 pp. 162–165.

Casey; *Pulp and Paper,* (Second ed.); Interscience Publishers Inc., N.Y. (1960) text.

Bariska "Collapse Phenomena in Bleechwood During and After $NH_3$-Impregnation"; *Wood & Science Technology,* vol. 9 (1975) pp. 293–306.

Parham, *Wood and Fiber;* vol. 2 #4 (Winter 1971) pp. 311–320.

Parham et al.; "Radial-Tangential Shrinkage of Ammonia-Treated Lobbly Pine Wood" *Wood Science* vol. 4 No. 3 (Jan. 1972).

Arlov et al.; "Paper Extensibility", *Pulp & Paper Int.,* 49, Jan. 1964.

*Primary Examiner*—Richard V. Fisher
*Assistant Examiner*—Steve Alvo
*Attorney, Agent, or Firm*—Murray and Whisenhunt

[57] ABSTRACT

The invention relates to a process comprising the saturation of a lignocellulosic or cellulosic pulp in gaseous ammonia. In one embodiment this is followed by subjection of the saturated pulp to vacuum. The treatment promotes the kinking of pulp fibres and/or improves the tearing strength of paper prepared therefrom.

21 Claims, 8 Drawing Figures

METHOD OF TREATING LIGNOCELLULOSIC OR CELLULOSIC PULP TO PROMOTE THE KINKING OF PULP FIBRES AND/OR TO IMPROVE PAPER TEAR STRENGTH

This is a continuation of application Ser. No. 855,677 filed Nov. 29, 1977, now abandoned.

BACKGROUND OF THE INVENTION

1. Field of Invention

This invention relates to a method of treating lignocellulosic or cellulosic pulp produced by chemical, semi-chemical, and chemimechanical types of pulping processes. More particularly it relates to the treatment of a lignocellulosic or cellulosic pulp with gaseous ammonia, which treatment promotes the kinking of pulp fibres and/or improves the tearing strength of paper prepared therefrom.

2. Description of the Prior Art

The kraft pulping process is a widely used chemical pulping process. Paper manufactured from kraft pulp is of good quality and is particularly characterised by high strength. However the kraft process is inherently highly polluting and the pulp is produced in a low yield, for example of about 45%. For purposes of this specification, the term "pulp yield" means the percentage of original dry wood material that is converted to dry pulp.

There are alternative high yield processes some of which are used commercially. Among these is the bisulphite process with which pulps have been produced at a yield in excess of 60%. There are in addition other high yield chemical or semi-chemical processes which have not yet achieved commercial acceptance. In addition less polluting processes, such as the two stage soda-oxygen pulping process have attracted considerable commercial interest.

As will be apparent from the above, alternatives to the kraft process can be attractive either because they are more acceptable environmentally or because they produce a greater yield of pulp. A disadvantage common to many of these alternative processes is that paper produced from the pulp resulting from these processes is a paper of low tearing strength. The other properties of papers produced from alternative pulps are in many cases either superior to or comparable with those of corresponding papers produced from kraft pulp. We have found that when a pulp prepared by a chemical or semi-chemical or chemimechanical process other than the kraft process is treated by the ammonia process according to the invention described and defined hereinbelow, there is an improvement in the tearing strength of the pulp so treated.

The gaseous ammonia treatment according to this invention also improves the tearing strengths of pulps produced by the kraft process and in this regard is particularly applicable to kraft pulps made from young, low density wood. Tearing strength is an important property in most end uses, particularly the manufacture of paper bags and sacks.

The treatment according to this invention has also been observed to induce and to set kinks in the pulp fibres. It is to be understood that what is meant by kinking of pulp fibres includes changes in the fibre configuration, such as, for example, in the extent of fibre twist, curl and kink as well as fibre wall dislocations, fractures, microcompressions and zones of dislocation. The presence of kinked fibres within a papermaking pulp is known to bring about an improvement in the properties of wet webs and in some of the papers produced from such webs. Kinked fibres are known to be particularly effective in developing extensibility in wet webs if the kinks are set in position so that they remain somewhat inflexible when the webs are subjected to strain during papermaking and dry lap production. Kinked fibres are also known to improve the extensibility of some papers produced from them.

Gaseous ammonia and aqueous ammonia solutions have been used as the alkaline reagent in oxidative delignification of lignocellulosic material and is described, for example, in British Pat. No. 1,381,728 and U.S. Pat. Nos. 3,617,432; 3,740,311; and, 4,002,526. Ammonia has also been used in conjunction with other gaseous reagents such as chlorine or chlorine dioxide to effect bleaching of wood pulp as is described, for example, in New Zealand Pat. No. 160,216, and U.S. Pat. No. 3,472,731.

In none of this prior art is there disclosed the use of ammonia in a separate treatment step in order to achieve the desired changes in the properties of the wood pulp being treated. The effects which gaseous ammonia has on wood pulp or other cellulosic fibres is unpredictable from any of the literature of which we are aware.

It is an object of this invention to go some way towards achieving the desiderata described above or at least providing the public with a useful choice.

SUMMARY OF THE INVENTION

Accordingly the invention may be said broadly to consist in a method of treatment of a lignocellulosic or cellulosic pulp derived from a chemical, semi-chemical or chemimechanical pulping process, which method comprises saturating said pulp with an effective amount of gaseous ammonia.

Preferably said effective amount is sufficient gaseous ammonia to be taken up by moist pulp in an amount greater than 3% by weight of oven dry pulp.

Preferably said treatment is effected by subjecting the said pulp to a substantially gaseous ammonia atmosphere under a pressure of at least 1 atmosphere (101.3 kPa).

Preferably said method comprises a cycle consisting essentially of a first step of subjecting said pulp to substantially gaseous ammonia atmosphere followed by subjecting said pulp to a vacuum.

Alternatively said process is carried out in two or more cycles, each cycle comprising a said subjection to an atmosphere of ammonia followed by subjection to vacuum.

One embodiment comprises treating pulp at a yield of up to 80%. Another embodiment comprises treating pulp having a consistency of up to 40 weight percent of dried pulp in the total material, water plus pulp.

Alternately the process comprises up to five pressure phases of up to 2 hours each alternating with pressure release phases of up to 1 hour between each phase.

DESCRIPTION OF THE PREFERRED EMBODIMENTS

The invention may be more fully understood by having reference to the following examples and tables, setting out the preferred embodiments of the invention. It is to be noted that these examples are exemplary and do not delimit the scope of the invention.

EXAMPLE 1

Sodium bisulphite pulps made from radiata pine slabwood chips in yields of 53, 60,67 and 75 percent were refined (beaten) to varying degrees (2000–8000 revolutions) in a laboratory PFI (Papirindustriens Forskninginstitutt) mill. Samples of the pulps were pressed to a consistency of 15–30 percent and then fluffed. Control (untreated) samples were washed with distilled water and standard paper handsheets made and tested. Additional pulp samples were placed in a stainless steel pressure vessel which was then evacuated for 10 minutes. These pulps were then treated with gaseous ammonia for 1–3 cycles of 15–45 minutes each at total pressures of 380–760 kPa. The vessel was evacuated for 10 minutes between treatment cycles and at the end of each treatment. Treated pulps were washed thoroughly with distilled water and standard paper handsheets made and tested.

Specific gaseous ammonia treatment conditions and the corresponding paper properties are given in Table 1. The gaseous ammonia treatment caused handsheet tearing strengths (tear index) to be increased significantly by up to 92 percent. The burst (burst index) and tensile (tensile index) strengths were decreased by proportionately small extents of up to 36 percent. Handhsheet stretch was not affected greatly by the treatment (this was confirmed in other experiments). Thus, pulps refined in order to develop paper stretch and burst and tensile strengths can then be treated with gaseous ammonia to selectively develop tearing strength.

EXAMPLE 2

Samples of the 60 percent yield bisulphite pulp referred to in Example 1 were refined for 5000 revolutions in a PFI mill, pressed to 22.5 percent consistency and fluffed.

TABLE 1

EFFECTS OF GASEOUS AMMONIA TREATMENT ON PAPER PROPERTIES

| | | TREATMENT CONDITIONS | | | | | | HANDSHEET PROPERTIES | | | | | | | |
|---|---|---|---|---|---|---|---|---|---|---|---|---|---|---|---|
| Example No. | Pulp type | Pulp yield (%) | PFI Beating (revs) | Stock Concn (%) | Number of Treatment Cycles | Time per cycle (min) | Ammonia Pressure (kPa) | Freeness (Csf) | Apparent density (kg/m$^3$) | Tear index (mN.m$^2$/g) | Burst index (kPa.m$^2$/g) | Tensile index (N.m/g) | Stretch (%) | Scattering Coeff. (cm$^2$/g) | Brightness (%) |
| 1. | Bisulphite slabwood | 53 | 2000 | 15 | — | Untreated | — | 782 | 600 | 14.7 | 5.6 | 70 | 2.7 | 176 | 43.1 |
| | | " | " | " | 3 | 45 | 380 | 746 | 577 | 23.6 | 4.3 | 54 | 2.8 | 195 | 37.3 |
| | | 53 | 8000 | 30 | — | Untreated | — | 422 | 644 | 12.6 | 6.6 | 74 | 3.0 | 157 | 42.2 |
| | | " | " | " | 1 | 45 | 760 | 669 | 592 | 22.1 | 4.3 | 51 | 2.7 | 198 | 35.8 |
| | | 60 | 5000 | 22.5 | — | Untreated | — | 668 | 583 | 13.4 | 6.1 | 76 | 2.7 | 171 | 40.2 |
| | | " | " | " | 2 | 30 | 570 | 734 | 554 | 21.4 | 4.1 | 54 | 2.8 | 190 | 30.4 |
| | | 67 | 2000 | 15 | — | Untreated | — | 766 | 492 | 16.8 | 4.3 | 61 | 2.3 | 196 | 39.1 |
| | | " | " | " | 1 | 45 | 380 | 751 | 493 | 22.1 | 3.7 | 51 | 2.2 | 196 | 30.4 |
| | | 67 | 8000 | 30 | — | Untreated | — | 680 | 553 | 11.7 | 5.6 | 70 | 2.8 | 176 | 37.2 |
| | | " | " | " | 3 | 15 | 380 | 728 | 535 | 22.5 | 3.6 | 48 | 2.5 | 189 | 29.3 |
| | | 75 | 8000 | 30 | — | Untreated | — | 737 | 498 | 14.1 | 4.7 | 59 | 2.2 | 190 | 47.3 |
| | | " | " | " | 1 | 60 | 760 | 753 | 502 | 17.7 | 3.8 | 45 | 2.1 | 190 | 36.7 |
| 2. | Bisulphite slabwood low application of gaseous ammonia (in admixture with nitrogen) | 60 | 5000 | 22.5 | — | Untreated | — | 650 | 583 | 12.5 | 6.2 | 73 | 2.8 | 167 | 39.6 |
| | | " | " | " | 1 | 45 | <120 | 658 | 582 | 13.1 | 5.9 | 72 | 2.8 | 165 | 35.9 |
| 3. | Soda-oxygen slabwood (29 Kappa No.) | 50 | 5000 | 15 | — | Untreated | — | 642 | 621 | 15.5 | 7.0 | 77 | 3.3 | 167 | 26.6 |
| | | " | " | " | 1 | 45 | 760 | 698 | 588 | 29.4 | 4.7 | 56 | 3.4 | 197 | 27.4 |
| | Bleached after treatment | " | " | " | " | " | " | 687 | 591 | 35.7 | 4.1 | 46 | 3.5 | 225 | 87.1 |
| | Bleached before treatment | " | " | " | " | " | " | 712 | 587 | 31.4 | 3.6 | 49 | 3.4 | 235 | 84.6 |
| 4. | Kraft slabwood (30 Kappa No.) | 48 | 2000 | 22.5 | — | Untreated | — | 736 | 565 | 25.5 | 4.2 | 56 | 2.6 | 189 | 23.2 |
| | | " | " | " | 2 | 30 | 570 | 741 | 534 | 29.0 | 2.5 | 37 | 2.2 | 215 | 23.5 |
| | | 48 | 8000 | 22.5 | — | Untreated | — | 658 | 613 | 21.4 | 6.2 | 72 | 3.1 | 163 | 22.1 |
| | | " | " | " | 2 | 30 | 570 | 724 | 562 | 31.7 | 3.2 | 46 | 3.1 | 192 | 22.2 |
| 5. | Kraft corewood (32 Kappa No.) | 48 | 2000 | 22.5 | — | Untreated | — | 659 | 709 | 17.0 | 5.8 | 54 | 5.6 | 202 | 23.4 |
| | | " | " | " | 2 | 30 | 570 | 687 | 684 | 19.7 | 5.1 | 49 | 6.4 | 232 | 24.5 |
| | | 48 | 8000 | 22.5 | — | Untreated | — | 555 | 751 | 15.2 | 6.6 | 71 | 6.2 | 151 | 21.0 |
| | | " | " | " | 2 | 30 | 570 | 660 | 712 | 18.3 | 4.9 | 59 | 6.6 | 211 | 23.3 |

An untreated sample was evaluated and a further sample treated in the manner described in example 1 except that a mixture of gaseous ammonia and nitrogen was bubbled through the pulp at a pressure lower than 120 kPa (less than 2 psig). This was done to determine the lower limits of ammonia application. The uptake was estimated from the rapid temperature increase (using the heat of solution of ammonia in water) to be approximately 8.6 percent by weight on oven dry pulp. Following treatment the pulp was evaluated.

Paper properties given in Table 1 showed that such a low uptake of ammonia had a very small effect on the handsheet properties. The most significant difference was an undesirable decrease in brightness.

EXAMPLE 3

Four samples of a two-stage soda-oxygen pulp made from radiata pine slabwood chips in a yield of 50 percent and with a Kappa number of 29 were refined for 5000 revolutions in a PFI mill and pressed to 15 percent consistency. The pulps were washed, fluffed and an untreated sample was evaluated (i.e. standard paper handsheets made and tested). Two samples were treated with gaseous ammonia in a manner similar to that described in example 1. (See Table 1 for specific treatment conditions). One of these pulps was washed and evaluated while the other was bleached to high brightness by a standed CEDED (chlorination, alkali extraction, chlorine dioxide bleach, alkali extraction, chlorine dioxide bleach) bleaching sequence prior to evaluation.

The fourth pulp was bleached in the same manner (CEDED sequence) and then treated with gaseous ammonia prior to evaluation.

Tearing strengths were greatly improved in all three ammonia treated soda-oxygen pulps (Table 1) by from 90 to 130 percent. Corresponding burst and tensile strengths were decreased, but to acceptable levels (i.e. 49 $N.m^2/g$ tensile index). Again handsheet stretch was retained following treatment with gaseous ammonia.

Tearing strengths of the two bleached pulps were even greater than those of the unbleached, treated pulp. Pulp treatment with ammonia before bleaching was slightly more effective than treatment after bleaching in developing both handsheet strength and brightness (Table 1).

EXAMPLE 4

Kraft pulp samples made from radiata pine slabwood chips in a yield of 48 percent and with a Kappa No. of 30 were refined in a PFI mill for 2000 and 8000 revolutions. Both untreated and gaseous ammonia treated (Table 1) pulps were evaluated.

Paper properties (Table 1) showed that the treatment improved tearing strengths but decreased burst and tensile strengths almost proportionately. As kraft slabwood pulps are generally already of high tearing strength, the treatment may not prove of great value for this purpose. However, as shown in Example 7, the treatment was beneficial for kraft slabwood pulps in that it promoted fibre kinking which improves wet web extensibility.

EXAMPLE 5

Kraft pulp samples made from radiata pine corewood (young wood) chips in a yield of 48 percent with a Kappa No. of 32 were refined as in Example 4. Untreated and gaseous ammonia treated pulps (Table 1) were evaluated.

Paper properties (Table 1) showed that gaseous ammonia treatment could be beneficial on corewood kraft pulps which generally are of low tearing strength and high burst and tensile strengths. Tear index was increased by about 3 units (20 percent) and the corresponding burst and tensile strengths were acceptable.

EXAMPLE 6

A sample (containing the equivalent of about 100 grams of oven-dry pulp) of the 53 percent yield bisulphite pulp (Example 1) was refined for 8000 revolutions, pressed to 15 percent consistency and fluffed. The moisture content of the pulp was determined by oven-drying three small samples and the remaining pulp was weighed and then treated with gaseous ammonia under extreme treatment conditions (3 cycles of 45 minutes each at a pressure of 760 kPa). The pulp was then washed, oven-dried, and weighed to determine the yield loss caused by the treatment.

The yield was found to decrease from 53 to 51.9 percent which is an extremely small yield loss, especially when possible losses due to handling are considered. Previous experiments indicated that the yield loss for bisulphite pulps was very small at all pulp yields considered (Example 1).

BRIEF DESCRIPTION OF THE FIGURES

The invention as it is described herein below in Example 7, may be more fully understood by having reference to the accompanying figures wherein.

EXAMPLE 7

Figure 1B:
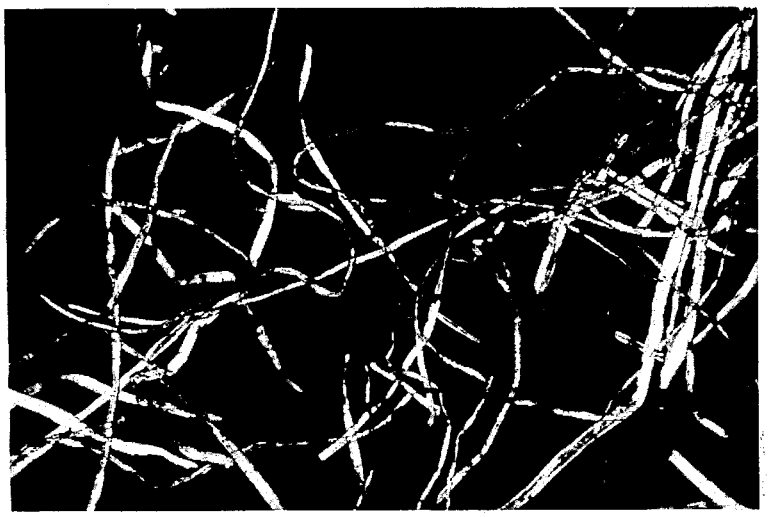
FIG. 1B is a photograph of a magnification of the same pulp treated with gaseous ammonia at a stock concentration of 30% over two cycles of 45 minutes per cycle under a pressure of 760 kPa.
Figure 1A:
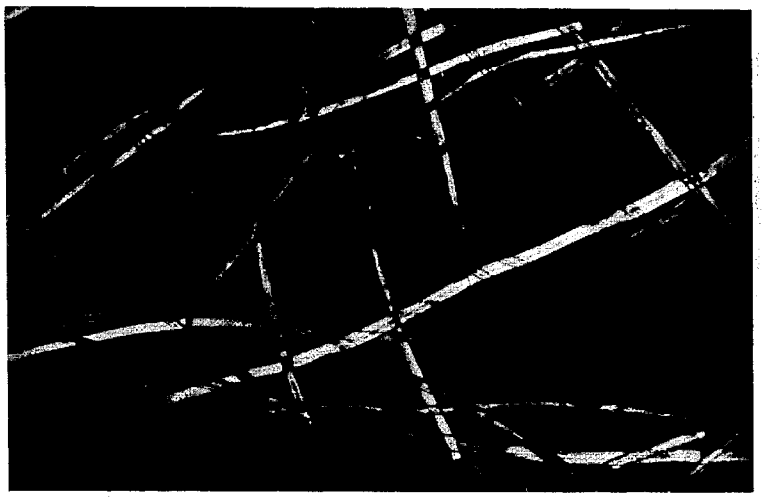
FIG. 1A is a photograph of a magnification of a pulp produced at a 53% yield at 8000 refining revolutions in a PFI mill without treatment according to the present process.
Figure 2B:
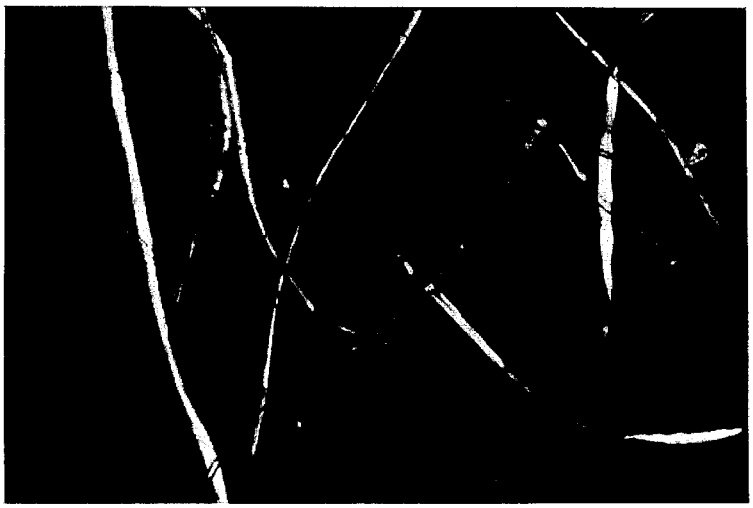
FIG. 2B is a photograph of a magnification of a pulp produced at a 67% yield at 8000 refining revolutions in a PFI mill without treatment according to the present process.
Figure 2A:
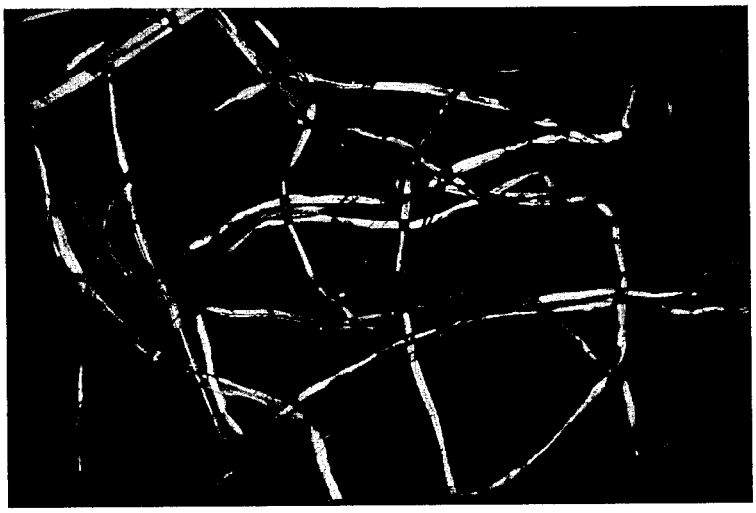
FIG. 2A is a photograph of the magnification of the same pulp treated with gaseous ammonia at a stock concentration of 30% over 3 cycles of 45 minutes per cycle under a pressure of 760 kPa.

Pulp treatment with gaseous ammonia caused fibres to become kinked to different extents depending on wood type, pulp type, pulp yield, pulp refining, and the conditions of treatment with ammonia (Table 2). Extents of fibre kink brought about by treatment with ammonia were greatest for the more heavily beaten low yield bisulphite pulps, and lowest for the less beaten high yield bisulphite pulps (FIG. 1,2). "Kink index" is a measure of both the number and degree of fibre kink. Kibblewhite, Tappi 57(8): 120-1 (1974).

Treatment with gaseous ammonia was effective in causing the fibres in a wide range of chemical and semi-chemical pulps to become kinked. These included sodium bisulphite, kraft, soda-oxygen, and neutra-sulphite-semi-chemical pulps produced from radiata pine wood chips. Pulps from selected slabwood and corewood (young or juvenile wood) chip samples were examined and found to be kinked to varying extents by pulp treatment with gaseous ammonia (Table 2).

Fibre kinking was strongly correlated with handsheet density. Extents of fibre kinking increased linearly with decreasing handsheet densities (Table 1). Similar, although less highly correlated trends were obtained for the extents of fibre kink and handsheet burst and tensile indices. Tearing strengths on the other hand were not necessarily linearly correlated with extents of fibre kinking. This conclusion was, however, based on a limited number of samples (Table 2) and tear/kinking correlations may well be obscured by the variation inherent in measuring tearing strength.

Figure 3B:
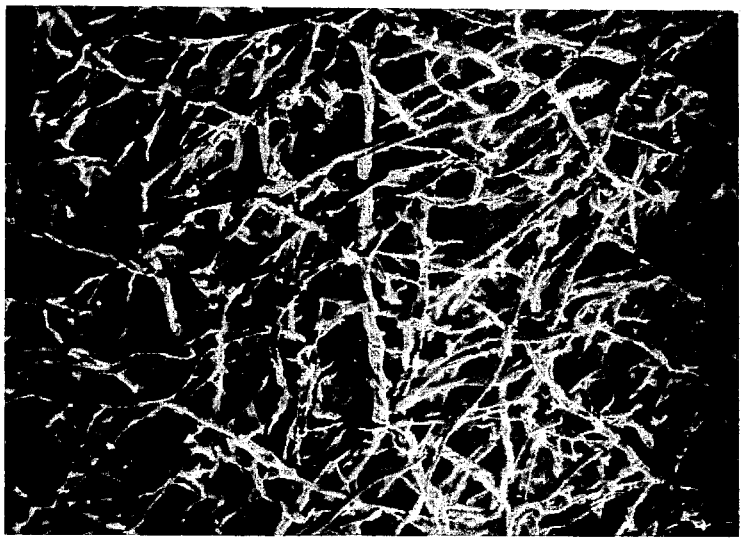
FIG. 3B illustrates the same web after straining to rupture.
Figure 3A:
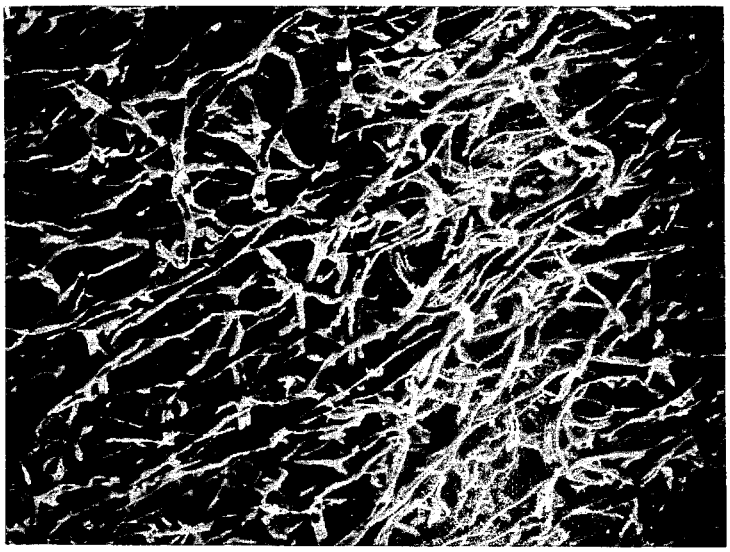
FIG. 3A is a photograph of a magnification of a wet web with a solids content of 22.7% prepared from a pulp of 53% yield at 8000 refining revolutions in a PFI mill, the wet web having been treated by the ammonia process of the present invention, before straining.

Kinked fibres developed by treatment with gaseous ammonia were found to resist straightening when in strained wet webs (FIG. 3). Extents of resistance to fibre straightening during wet web straining were dependent on fibre type, pulp yields, degrees of pulp refining before treatment, wet web solid contents, and the extents of fibre kink developed by ammonia treatment. Fibre kinks were apparently both developed and set into position (to different degrees) by pulp treatment with gaseous ammonia.

Figure 4B:
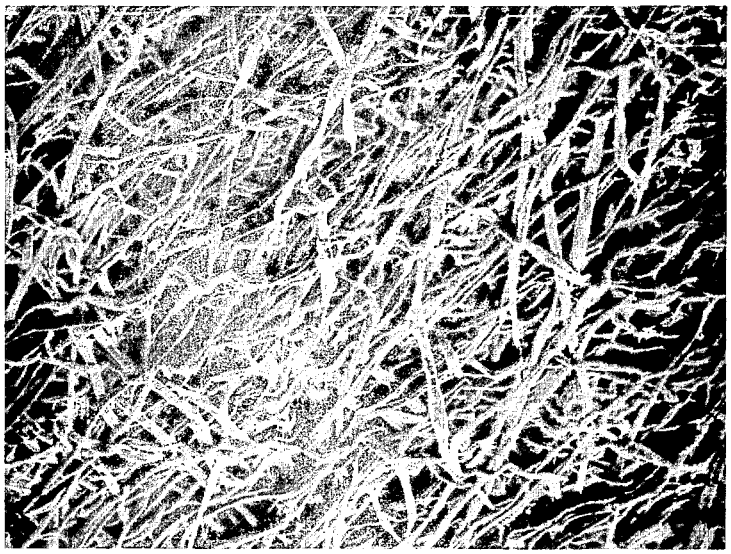
FIG. 4B is a photograph of a magnification of the same wet web strained to rupture.
Figure 4A:
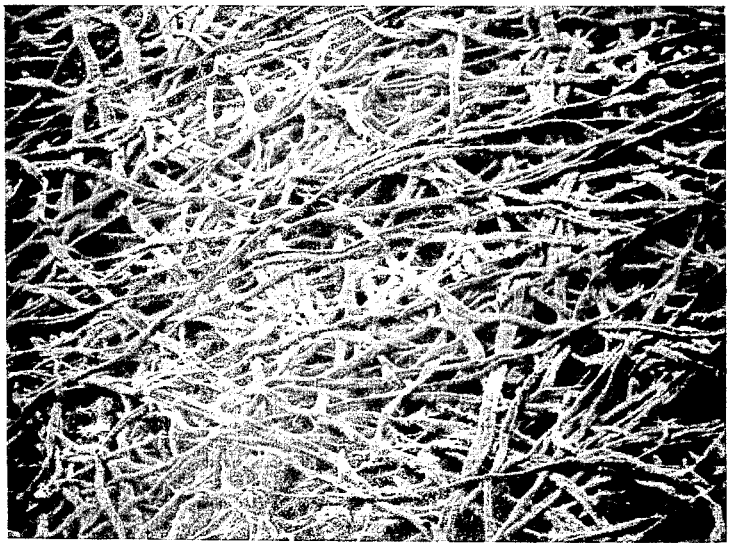
FIG. 4A is a photograph of a magnification of a wet web prepared from a pulp which has not been treated by the ammonia process of the present invention, the web having a solids content of 24.5% and having been produced at a pulp yield of 53% at 8000 refining revolutions on a PFI mill, the web being unstrained.

Wet webs prepared from treated pulps containing strongly kinked fibres were observed to remain essentially unchanged when these webs were strained to the point of rupture (FIG. 3). Fibrillar networks connecting adjacent fibres were found to remain essentially intact in the strained webs. Thus, the kinked fibres were not moved relative to one another to large extents as the wet web was strained to the point of rupture. The kinked fibres were, however, straightened and fibrillar networks were disrupted when they were located within the rupture zone, as expected. Examination of wet webs prepared from corresponding untreated pulps showed low extents of fibre kink before straining, and increased degrees of fibre straightening and fibre orientation as these wet webs were strained to rupture (FIG. 4).

Pulp treatment with gaseous ammonia in general caused wet web tensile and stretch properties to be respectively decreased and increased (Table 2). Effects of the ammonia treatment on wet web strength properties generally compared with those of corresponding dry handsheets although increases in wet web extensibilities brought about by the pulp treatment were often proportionately greater than those in the dry papers. The small increases in wet web extensibility and the relatively large decreases in wet web tensile strengths were related to the decreased apparent densities (increased bulks) of the wet webs which were brought about by pulp treatment with gaseous ammonia (Table 2).

The wet web strength data are included as an indication of the effects of treatment with gaseous ammonia, and are only applicable for webs without fibre orientation at solid contents of 20–25 percent. Wet web strips were formed using a British standard sheet machine and tested on an Instron tester using jaws described by Stephens and Pearson (Appita 23(4): 261–74 (1970)).

TABLE 2

EFFECTS OF GASEOUS AMMONIA TREATMENT ON THE DEVELOPMENT OF FIBRE KINKING

| | | | Pulp | AMMONIA TREATMENT CONDITIONS | | | | | |
|---|---|---|---|---|---|---|---|---|---|
| No. | Pulp Type | Pulp Yield (%) | Beating before trmt (rev) | Stock concn (%) | No. of Cycles | Time Per Cycle (min) | Pressure (kPa) | Kinks (No. per mm of fibre) | Kink Index (per mm fibre)* |
| 1 | Bisulphite slabwood | 53 | 8000 | — | Untreated | | — | 1.5 | 1.9 |
| | | | | 30 | 1 | 15 | 380 | 1.8 | 2.3 |
| | | | | 15 | 1 | 15 | 760 | 2.1 | 2.7 |
| | | | | 15 | 3 | 45 | 760 | 3.7 | 6.0 |
| | | | | 30 | 3 | 45 | 760 | 4.6 | 8.3 |
| 2 | Bisulphite slabwood | 67 | 8000 | — | Untreated | | — | 1.8 | 2.2 |
| | | | | 15 | 1 | 45 | 760 | 2.7 | 3.5 |
| | | | | 30 | 1 | 45 | 380 | 2.7 | 3.7 |
| | | | | 30 | 3 | 15 | 380 | 3.1 | 4.1 |
| | | | | 30 | 3 | 45 | 760 | 3.9 | 5.9 |
| | | | | 30 | 1 | 45 | 760 | | |
| 3 | Kraft slabwood | 48 (Kappa No. 30) | 7000 | — | Untreated | | — | 1.6 | 1.9 |
| | | | | 15 | 1 | 45 | 760 | 2.4 | 3.4 |
| 4 | Kraft corewood | 48 (Kappa No. 32) | 9000 | — | Untreated | | — | 2.8 | 4.0 |
| | | | | 15 | 1 | 45 | 760 | 4.8 | 8.2 |
| 5 | Soda-oxygen slabwood | 50 (Kappa No. 29) | 5000 | — | Untreated | | — | 1.5 | 1.7 |
| | | | | 15 | 1 | 45 | 760 | 2.6 | 3.6 |

| | HANDSHEET PROPERTIES | | | | WET WEB PROPERTIES | | |
|---|---|---|---|---|---|---|---|
| No. | Tear index ($mN.m^2/g$) | Tensile index (N.m/g) | Stretch (%) | Apparent density ($kg/m^3$) | Tensile index (N.m/g) | Stretch (%) | Web solids content (%) |
| 1 | 12.6 | 73 | 3.0 | 644 | 1.31 | 15.6 | 24.5 |

TABLE 2-continued

EFFECTS OF GASEOUS AMMONIA TREATMENT ON THE DEVELOPMENT OF FIBRE KINKING

| | | | | | | | |
|---|---|---|---|---|---|---|---|
| | 20.4 | 51 | 2.7 | 633 | 1.12 | 14.2 | 22.0 |
| | 18.5 | 61 | 3.0 | 629 | 1.11 | 15.8 | 21.1 |
| | 23.4 | 43 | 2.9 | 573 | 0.75 | 18.5 | 21.8 |
| | 21.5 | 37 | 2.9 | 561 | 0.65 | 17.6 | 22.7 |
| 2 | 11.7 | 69 | 2.8 | 553 | 0.74 | 7.4 | 22.2 |
| | 17.0 | 56 | 2.7 | 530 | | | |
| | 19.2 | 50 | 2.6 | 534 | | | |
| | 22.4 | 48 | 2.5 | 535 | | | |
| | 16.7 | 41 | 2.6 | 516 | | | |
| | | | | | 0.61 | 9.1 | 24.1 |
| 3 | 18.8 | 77 | 3.1 | 622 | 1.14 | 10.4 | 24.1 |
| | 31.3 | 57 | 3.2 | 585 | 0.76 | 11.9 | 20.9 |
| 4 | 16.2 | 73 | 6.2 | 754 | 1.11 | 16.1 | 22.6 |
| | 18.6 | 56 | 6.6 | 718 | 0.73 | 16.8 | 19.2 |
| 5 | 15.5 | 77 | 3.3 | 621 | 1.05 | 11.7 | 21.5 |
| | 29.4 | 56 | 3.4 | 588 | 0.77 | 13.4 | 21.0 |

What we claim is:

1. A method of kinking pulp fibers in order to increase the tear strength of papers made from such fibers, wherein the pulp is a lignocellulosic or cellulosic pulp derived from a chemical, semichemical or chemimechanical pulping process, said method comprising kinking pulp fibers having a consistency of approximately 15 up to approximately 400 weight percent of dried pulp in the total material, water plus pulp, while substantially maintaining pulp yield by treating the pulp with gaseous ammonia at a pressure of at least one atmosphere until at least 9% by weight, based on the weight of oven dried pulp, of gaseous ammonia has been taken up by the moist pulp.

2. The method according to claim 1 wherein said pulp is a softwood pulp.

3. The method according to claim 1 wherein said pulp is derived in a yield of up to 80%.

4. The method according to claim 1 wherein said pulp is a semi-chemical pulp derived in a yield of up to 75%.

5. The method according to claim 1 wherein said pulp is produced by a bisulphite process in a yield of up to 75%.

6. The method according to claim 1 wherein said pulp is a chemical pulp.

7. The method according to claim 1 wherein said pulp has a consistency of up to 30 weight percent of dried pulp in the total material, water plus pulp.

8. The method according to claim 1 wherein said treatment with gaseous ammonia is followed by a pressure release.

9. The method according to claim 8 wherein said treatment with gaseous ammonia is carried out in a cyclical manner with a pressure phase followed by a pressure release.

10. The method according to claim 9 including up to five pressure phases alternating with pressure release phases of up to 1 hour between each phases.

11. The method according to claim 10 wherein each said pressure phase is applied for up to 2 hours.

12. The method according to claim 1 wherein said pulp is refined prior to said treatment with said gaseous ammonia.

13. The method according to claim 1 wherein said pulp is not refined prior to said treatment with gaseous ammonia.

14. The method according to claim 1 wherein said pulp is bleached prior to said treatment with gaseous ammonia.

15. The method according to claim 1 wherein said pulp is bleached following said treatment with gaseous ammonia.

16. The method according to claim 1 wherein said treatment with gaseous ammonia is carried out at a temperature of 0–150° C.

17. Method according to claim 1 wherein said pulp is a chemical pulp produced by a process selected from the group consisting of Kraft-type processes and soda-oxygen-type processes.

18. Method according to claim 1 wherein said treatment with gaseous ammonia is followed by subjecting said pulp to a vacuum.

19. Method according to claim 18 wherein said treatment with gaseous ammonia is carried out in a cyclical manner with a pressure phase followed by a vacuum phase.

20. Method according to claim 19 including up to 5 pressure phases alternating with vacuum phases of up to one hour between phases.

21. Method according to claim 1 wherein said pressure is up to 15 atmospheres.

* * * * *